US011621113B2

(12) United States Patent
Handy et al.

(10) Patent No.: US 11,621,113 B2
(45) Date of Patent: Apr. 4, 2023

(54) ELECTROMAGNETIC DEVICE WITH THERMALLY CONDUCTIVE FORMER

(71) Applicant: GE Aviation Systems Limited, Gloucestershire (GB)

(72) Inventors: Peter James Handy, Cheltenham (GB); Michael James Smith, Chadlington (GB)

(73) Assignee: GE Aviation Systems Limited, Cheltenham (GB)

( * ) Notice: Subject to any disclaimer, the term of this patent is extended or adjusted under 35 U.S.C. 154(b) by 664 days.

(21) Appl. No.: 16/693,893

(22) Filed: Nov. 25, 2019

(65) Prior Publication Data

US 2020/0168385 A1 May 28, 2020

(30) Foreign Application Priority Data

Nov. 26, 2018 (GB) ..... 1819179

(51) Int. Cl.

| | |
|---|---|
| ***H01F 27/24*** | (2006.01) |
| ***H01F 27/22*** | (2006.01) |
| ***H01F 27/08*** | (2006.01) |
| ***H01F 27/28*** | (2006.01) |

(52) U.S. Cl.

CPC ..... *H01F 27/24* (2013.01); *H01F 27/085* (2013.01); *H01F 27/22* (2013.01); *H01F 27/2823* (2013.01)

(58) Field of Classification Search

CPC ..... H01F 27/24; H01F 27/085; H01F 27/22; H01F 27/2823; H01F 27/325; H01F 27/2876; H01F 5/02

See application file for complete search history.

(56) References Cited

U.S. PATENT DOCUMENTS

| | | | |
|---|---|---|---|
| 3,428,928 | A | 2/1969 | Maines |
| 3,659,239 | A | 4/1972 | Marton |
| 4,897,626 | A | 1/1990 | Fitter |
| 5,469,124 | A | 11/1995 | O |
| 5,954,988 | A | 9/1999 | Lee |
| 6,259,347 | B1 | 7/2001 | Sines |
| 6,600,402 | B1 | 7/2003 | LaFleur et al. |
| 6,777,835 | B1 | 8/2004 | Sines |

(Continued)

FOREIGN PATENT DOCUMENTS

| | | | |
|---|---|---|---|
| JP | H02290138 | A | 11/1990 |
| WO | 2018095512 | A1 | 5/2018 |

OTHER PUBLICATIONS

Combined Search and Examination Report Under Sections 17 and 18(3), dated Mar. 27, 2019, in related GB Patent Application No. 1819179.1, 8 pages, South Wales.

(Continued)

*Primary Examiner* — Lincoln D Donovan
*Assistant Examiner* — Alex W Lam
(74) *Attorney, Agent, or Firm* — McGarry Bair PC

(57) ABSTRACT

An electromagnetic device and method for cooling the electromagnetic device comprising a permeable magnetic core having a plurality of legs, a former located adjacent the permeable magnetic core wherein the former is thermally conductive, and at least one winding configured to conduct an electrical current there through wound on the former, the at least one winding including a coil having a plurality of turns.

20 Claims, 5 Drawing Sheets

(56) References Cited

U.S. PATENT DOCUMENTS

| | | | | |
|---|---|---|---|---|
| 10,650,959 | B1 * | 5/2020 | Folker | H01F 38/023 |
| 2013/0187738 | A1 | 7/2013 | Pal et al. | |
| 2013/0293330 | A1 * | 11/2013 | Wu | H01F 5/02 336/61 |
| 2015/0318106 | A1 | 11/2015 | Pollock et al. | |
| 2020/0066435 | A1 * | 2/2020 | Igarashi | H01F 27/292 |

OTHER PUBLICATIONS

European Patent Office, Extended European Search Report re Corresponding Application No. 19211325.6-1212 /3657518, dated Apr. 20, 2020, 11 pages, Munich, Germany.

* cited by examiner

ELECTROMAGNETIC DEVICE WITH THERMALLY CONDUCTIVE FORMER

CROSS REFERENCE TO RELATED APPLICATION(S)

This application claims priority to and benefit of GB Patent Application No. 1819179.1 filed Nov. 26, 2018, which is incorporated herein in its entirety.

TECHNICAL FIELD

The disclosure relates to a method and apparatus for an electromagnetic device, more specifically for an electromagnetic device with a permeable magnetic core and a former where the permeable magnetic core and the former provide thermal heat paths.

BACKGROUND

Electromagnetic devices, such as transformers are used to transform, change, or modify voltages utilizing alternating currents. The construction of these types of electromagnetic devices typically includes a central core constructed from a highly magnetically permeable material to provide a required magnetic path. The ability of iron or steel to carry magnetic flux is much greater than that of air, this is known as the permeability of the core and this influences the materials used for the core portion of a transformer.

BRIEF DESCRIPTION

In one aspect, the disclosure relates to an electromagnetic device, comprising a permeable magnetic core having a plurality of legs, a former located adjacent the permeable magnetic core wherein the former is thermally conductive at a rate equal to or higher than 0.5 W/mK, and at least one winding configured to conduct an electrical current there through wound on the former, the at least one winding including a coil having a plurality of turns, wherein the former is configured to provide additional thermal heat paths for heat generated in the at least one winding during operation.

In another aspect, the disclosure relates to a method for cooling an electrical device having electrically conductive windings, comprising placing a thermally conductive former having a primary shank about a leg of a permeable magnetic core having a plurality of legs, the thermally conductive former being capable of conducting heat from the windings at a rate equal to or higher than 0.5 W/mK, with the windings being wound on the shank, and conducting the heat from the windings through thermally conductive former thereby cooling the electrical device.

DETAILED DESCRIPTION

When a magnetic flux flows in a transformer core, two types of losses occur, eddy current losses and hysteresis losses. Hysteresis losses are caused because of the friction of the molecules against the flow of the magnetic lines of force required to magnetize the core, which are constantly changing in value and direction first in one direction and then the other due to the influence of an alternating supply voltage, which by way of non-limiting example can be either sinusoidal, square, or some other wave shape. This molecular friction causes heat to be developed which represents an energy loss to the transformer. Excessive heat loss can overtime shorten the life of the insulating materials used in the manufacture of the windings and structures. Therefore, cooling of a transformer is important.

When implementing high efficiency power converters, it is desirable to minimize the cooling infrastructure required. The main dissipaters in a typical solid state power converter are the main switching semiconductors, the transformer, and the input/output chokes. Thermal management of transformers and chokes can be driven by the electromagnetic and packaging requirements. Thermal losses in transformers and chokes can be split into two categories, core losses where power is dissipated in the magnetically permeable core, and winding losses where power is dissipated due to resistance in the current carrying windings.

Figure 1:
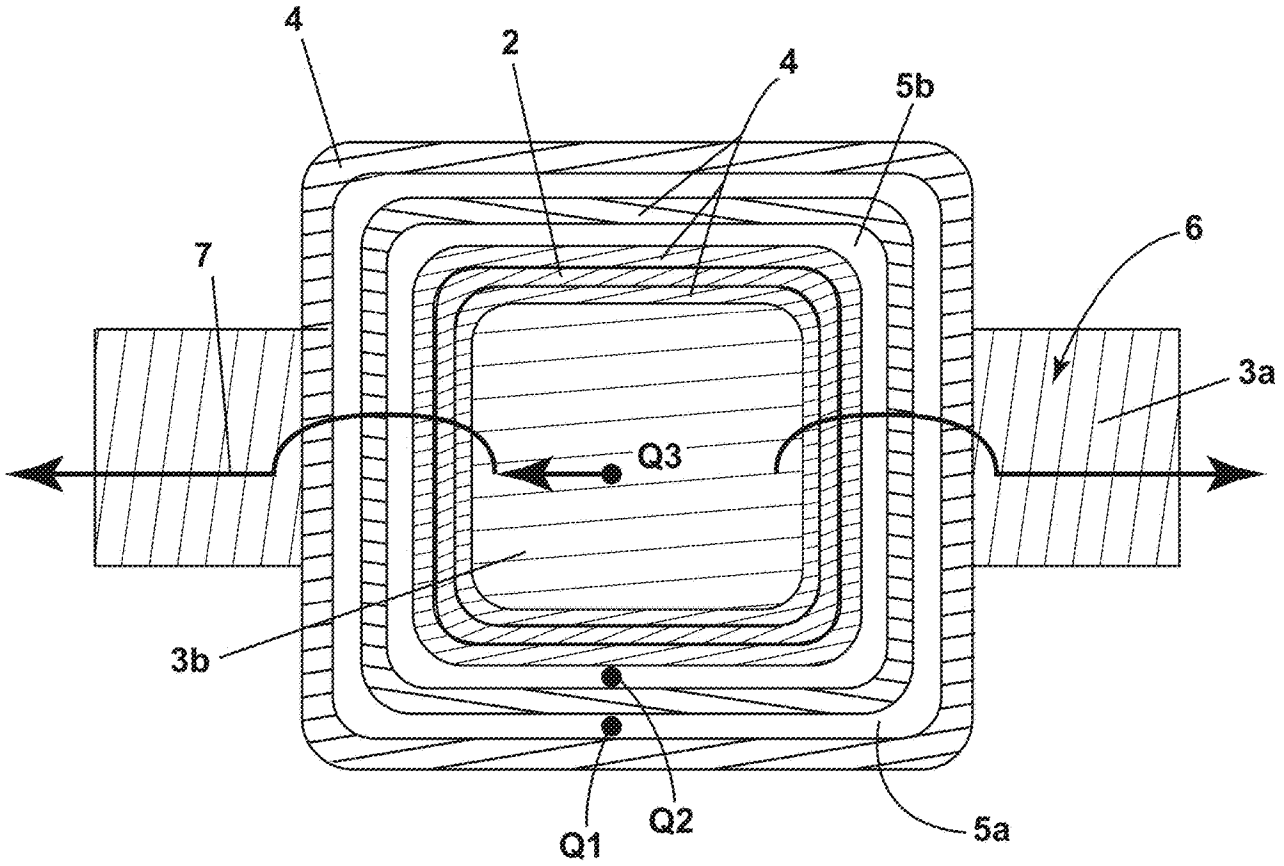
FIG. 1 Prior Art
FIG. 1 is a cross-section of an electromagnetic device showing thermal heat paths according to the prior art.

A conventional typical transformer includes electrically conductive windings for a transformer or choke wound on a non-thermally and non-electrically conductive plastic former. The plastic former produces a significant thermal resistance between the windings and the core. For example, FIG. 1 illustrates a prior art E-core electromagnetic device 1 with a former 2. The former 2 is spaced from a central leg 3*b* of the E-core electromagnetic device 1 with a layer of non-thermally conductive insulation material 4, by way of non-limiting example electrically insulation tape, potting compound, electrical screen or the like. Primary winding 5*a* and secondary winding 5*b* are wrapped about the former 2 and interspersed with layers of non-thermally conductive insulation material 4. Another layer of non-thermally conductive insulation material 4 circumscribes all of the layers. The layers of insulation material can be the same or differing material. By way of non-limiting examples, the non-thermally conductive insulation material can also include heat resistant silicone and be in the form of silicone, oil, grease, rubber, resin, caulk, or the like.

The primary winding 5*a* is connected to a voltage source such that when current is received within the coils of wire creating the primary winding 5*a*, the primary winding 5*a* becomes a first heat source Q1. An induced voltage is produced in the secondary winding 5*b* causing a current to flow through the coils of wire forming the secondary winding 5*b*, and therefore the secondary winding 5*b* becomes a second heat source Q2. The flow of a current within the primary and secondary windings 5*a*, 5*b* produces a magnetic flux within a permeable magnetic core (PMC) 6 of the E-core electromagnetic device 1 that can change direction depending on the direction of current at any given time. This change in magnetic flux produces heat in the PMC 6, such that the PMC 6 itself is a third heat source Q3.

A thermal heat path 7 along which heat can dissipate is naturally formed between the exterior legs 3*a* and the central leg 3*b* due to the E-shape. However, heat produced within the primary winding 5*a* and secondary winding 5*b* does not have a direct path which can cause a slow rate of heat dissipation.

Electromagnetic devices require cooling of the infrastructure during operation. Additionally decreasing the operating temperature of any surrounding power electronics is also beneficial. Traditional transformer designs using high thermal resistance coil formers tend to result in the windings transferring significant power, and therefore heat, into the surrounding circuit board/power electronics. The disclosure described herein reduces the thermal impedance between the windings and the core, thus allowing the heat generated in both core and winding losses to be easily extracted from the core surface. Among other things, the present disclosure relates to an electromagnetic device with a permeable magnetic core and a thermally conductive former surrounding the core. As described herein, the electromagnetic device can be a transformer having an E-core where the former circumscribes the central leg of the E-shaped transformer.

Figure 2:
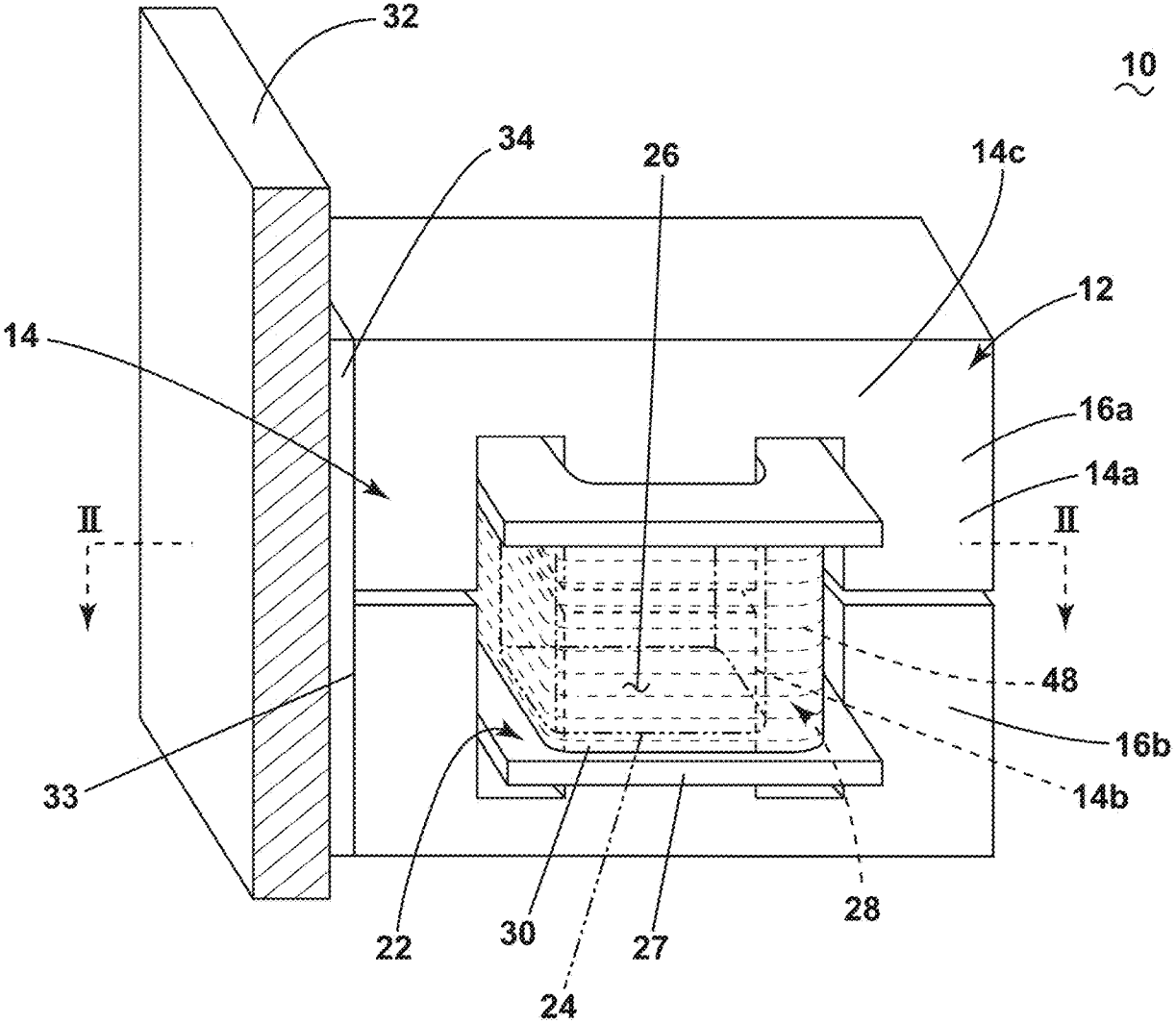
FIG. 2 is a perspective view of an electromagnetic device according to an aspect of the present disclosure.

FIG. 2 is a perspective view of an electromagnetic device 10 having, by way of non-limiting example, two permeable magnetic core halves (PMC) 12 according to an aspect of the present disclosure. It is contemplated that each core halve is a solid core as illustrated and made of ferrite, iron, or steel, however any magnetic or ferromagnetic material is contemplated. It is further contemplated that the PMC 12 as described herein can be formed from multiple layers of laminations. Each PMC 12 includes a plurality of legs 14, by way of non-limiting example two exterior legs 14*a* and a central leg 14*b* connected by a back portion 14*c* forming an E-core 16*a*. The E-core 16*a* can be coupled to a second E-core 16*b*, to form a standard "E-E" shell-type transformer. The electromagnetic device 10 can be in the form of other transformers, including but not limited to an "E-I" shell-type transformer core, or core-type transformer cores which include "L-L" and "U-I" shapes.

A former 22 can be included in the electromagnetic device 10 and can include a primary shank 24 extending between two caps 27 and defining a hollow interior 26. The former 22 can be located adjacent the PMC(s) 12 where the central leg(s) 14*b* are received within the hollow interior 26. The former 22 can be a piece of material, such as plastic or a composite. At least one winding 28, an electrically conductive winding including several coils of wire 48, can be wrapped around the primary shank 24. An outer layer 30 of insulation material can be located about the at least one winding 28.

In a non-limiting example, a cold wall 32 can be located proximate the PMC(s) 12, more specifically adjacent exterior legs 14*a* along a distal end of the PMC(s) 12. A thermally conductive material 34 can be located along an outside wall 33 of the exterior leg 14*a* between the distal end of the exterior leg(s) 14*a* and the cold wall 32. The thermally conductive material 34 can be, by way of non-limiting example, a thermally conductive silicone pad.

Figure 3:
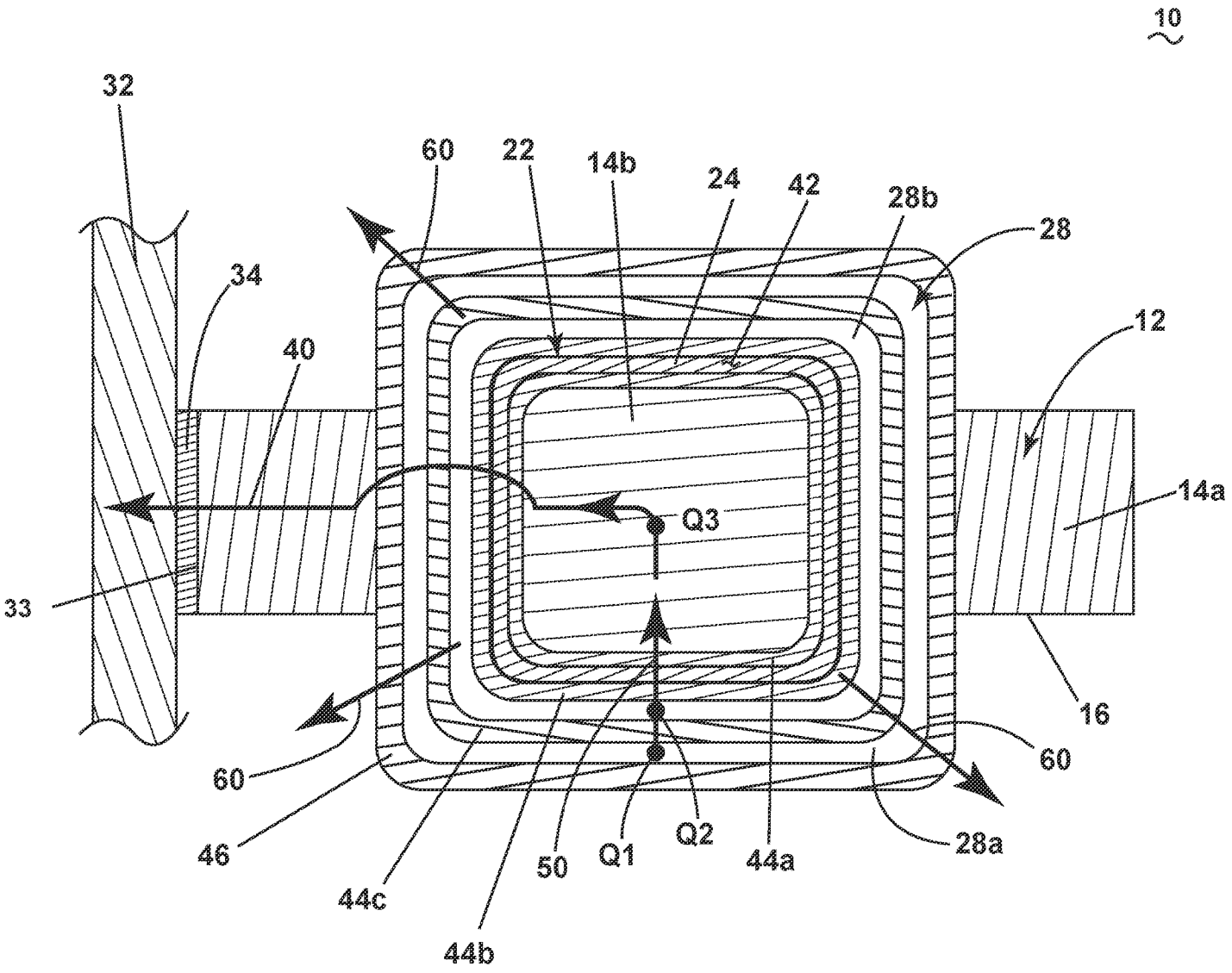
FIG. 3 is a cross-section of the electromagnetic device taken along line of FIG. 2.

FIG. 3 illustrates a cross-section of the electromagnetic device 10. The thermally conductive former 22, including the primary shank 24, is made of a heat conductive material 42, by way of non-limiting example a thermally conductive plastic polymer at a rate equal to or higher than 0.5 W/mK. In another aspect of the disclosure herein the heat conductive material 42 can have a thermally conductive rate between 1 and 10 W/mK. In yet another aspect, the thermal conductivity of the heat conductive material 42 can be between 10 and 100 W/mK. It is further contemplated the thermally conductive former 22 and therefore the heat conductive material 42 does not have any significant magnetic permeability.

The central leg 14*b* of the PMC 12 is received within the primary shank 24. The primary shank 24 can be spaced from the central leg 14*b* of the PMC 12 with a first layer of a thermally conductive material 44*a*. The at least one winding 28 can include a primary winding 28*a* and a secondary winding 28*b*. The secondary winding 28*b* can be spaced from the primary shank 24 with a second layer of thermally conductive material 44*b*. The primary winding 28*a* can be spaced from the secondary winding 28*b* with a third layer of thermally conductive material 44*c*. Finally an outer layer of thermally conductive material 46 can circumscribe all of the layers. The outer layer of thermally conductive material 46 can also be the same material as the layers of thermally conductive materials 44*a*, 44*b*, and 44*c*. The thermally conductive materials 44*a*, 44*b*, 44*c*, and 46 disclosed herein can be, by way of non-limiting example, a silicone loaded gap filler that is thermally conductive at a rate equal to or higher than 0.5 W/mK. In another aspect of the disclosure, the thermally conductive materials can have a thermally conductive rate between 1 and 10 W/mK. In yet another aspect, the thermal conductivity of the materials can be between 10 and 100 W/mK. It should be understood that any material having a high thermal conductivity and a low or zero electrical conductivity is suitable. Higher thermal conductivities of 100 W/mK to 500 W/mK are also contemplated.

During operation, the primary winding 28*a* can become a first heat source Q1 while the secondary winding 28*b* can be a second heat source Q2, and the PMC 12 itself can be a third heat source Q3. A thermal heat path 40 is naturally formed between the exterior legs 14*a* and the central leg 14*b* through the back portion 14*c* (FIG. 2) due to the E-shape. Further still, a second thermal heat path 50 is formed between all three sources of heat Q1, Q2, Q3, because of the inclusion of the former 22 and the thermally conductive materials. The second heat path 50 provides a direct path from the at least one winding 28 to the PMC(s) 12 or vice versa depending on the thermal gradient. While heat paths 40 and 50 illustrate high thermal conductivity heat paths due to the material properties of the former 22 and the PMC(s) 12, it should be understood that other heat paths 60 are formed. The thermal conductivity of the layered materials enables heat to more quickly dissipate into the ambient air surrounding the PMC(s) 12 along the other heat paths 60. One benefit of the former 22 having thermally conductive properties is that heat produced by the at least one winding 28 and the PMC 12 can dissipate along the thermal heat paths 40, 50, 60 at a higher rate when compared to the electromagnetic device 1 of FIG. 1. It should be understood that the heat paths shown are for illustrative purposes only and not meant to be limiting. They can overlap, or be considered one path. A higher dissipation rate of heat equates with a higher capacity to handle incoming heat or the permitted power from an electronic device. This can result in either smaller electronic devices with the same power capabilities when compared to electronic devices without thermally conductive layers or electronic devices similar in size with higher power capabilities.

At least one of the exterior legs 14*a* can be operably coupled to the cold wall 32 such that the thermal heat path 40 and at least a portion of the thermal heat path 50 terminate in the cold wall 32. Connecting the PMC(s) 12 to a cold wall 32 via a low resistance thermally conductive material 34 causes the heat in the PMC(s) 12 created from power dissipation to flow towards the cold wall and thus the core temperature is held closer to that of the cold wall 32.

A method for cooling an electrical device, by way of non-limiting example the electromagnetic device 10, includes placing the primary shank 24 of the thermally conductive former 22 about a leg, by way of non-limiting example the central leg(s) 14*b* of the PMC(s) 12 and conducting the heat Q2, Q3 from the windings 28, by way of non-limiting example along the second thermal heat path 50, through the thermally conductive former 22 thereby cooling the electrical device 10.

The method can further include impregnating thermally conductive material 44*a*, 44*b*, 44*c* between the PMC(s) 12, the thermally conductive former 22, the primary winding 28*a*, and the secondary winding 28*b*. It is also contemplated to impregnate an outer layer of thermally conductive material 46.

The method can include operably connecting the primary winding 28*a* of the electromagnetic device 10 to a voltage source such that when current is received within the coils of wire 48 a voltage is induced in the secondary winding 28*b* causing a current to flow through the coils of wire creating the secondary winding 28*b*.

Figure 4:
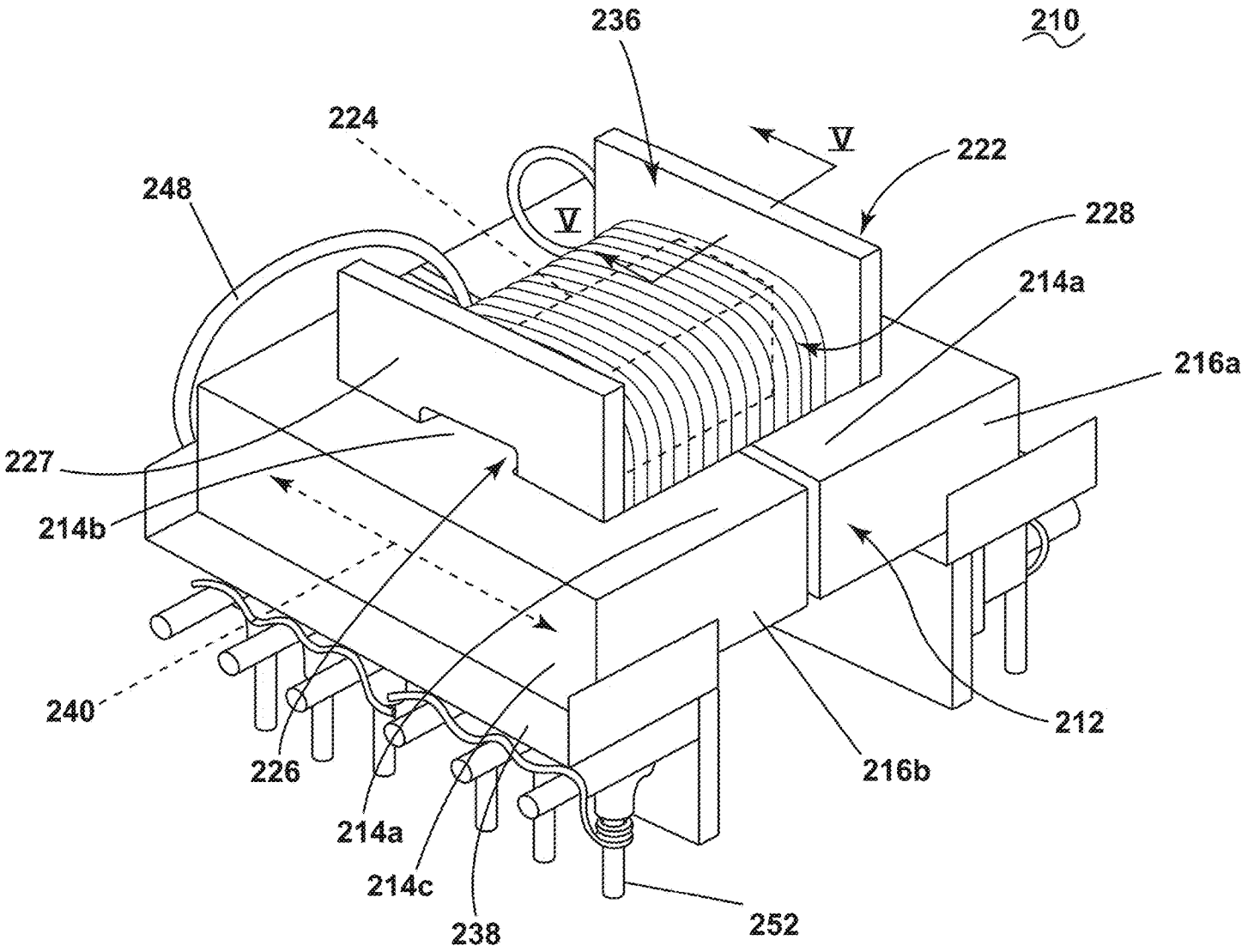
FIG. 4 is a perspective view of an electromagnetic device according to another aspect of the disclosure herein.

Turning to FIG. 4, a perspective view of an electromagnetic device 210, according to another aspect disclosed herein is illustrated. The electromagnetic device 210 is substantially similar to the electromagnetic device 10. Therefore, like parts will be identified with like numerals increased by 200, with it being understood that the description of the like parts of the electromagnetic device 10 applies to the electromagnetic device 210 unless otherwise noted.

The electromagnetic device 210 can be a transformer, by way of non-limiting example an "E-E" transformer with a PMC 212 having first and second identical E-core halves 216*a*, 216*b*. The E-core halves 216*a*, 216*b* each can include a back portion 214*c* from which a plurality of legs 214 extend. More specifically illustrated and described as two exterior legs 214*a* and a central leg 214*b*. A thermally conductive former 222 can include an interior section 236 including a primary shank 224 defining a hollow interior 226 and extending between two caps 227. The central legs 214*b* are located within the hollow interior 226 of the primary shank 224. Distal sections 238 of the thermally conductive former 222 form a base in which the PMC(s) 212 are retained. The distal sections 238 extend past the back portions 214*c* of the E-core halves 216*a*, 216*b*.

A set of electrically conductive pins 252 extend from at least one of the distal sections 238 of the thermally conductive former 222. At least one winding 228, formed from a plurality of coiled wire 248, is wrapped around the primary shank 224 of the thermally conductive former 222. The wire 248 can extend from the at least one winding 228 and can be wrapped around the set of electrically conductive pins 252 forming a direct electrical and thermal path between the at least one winding 228 and the at least one pin 252.

Figure 5:
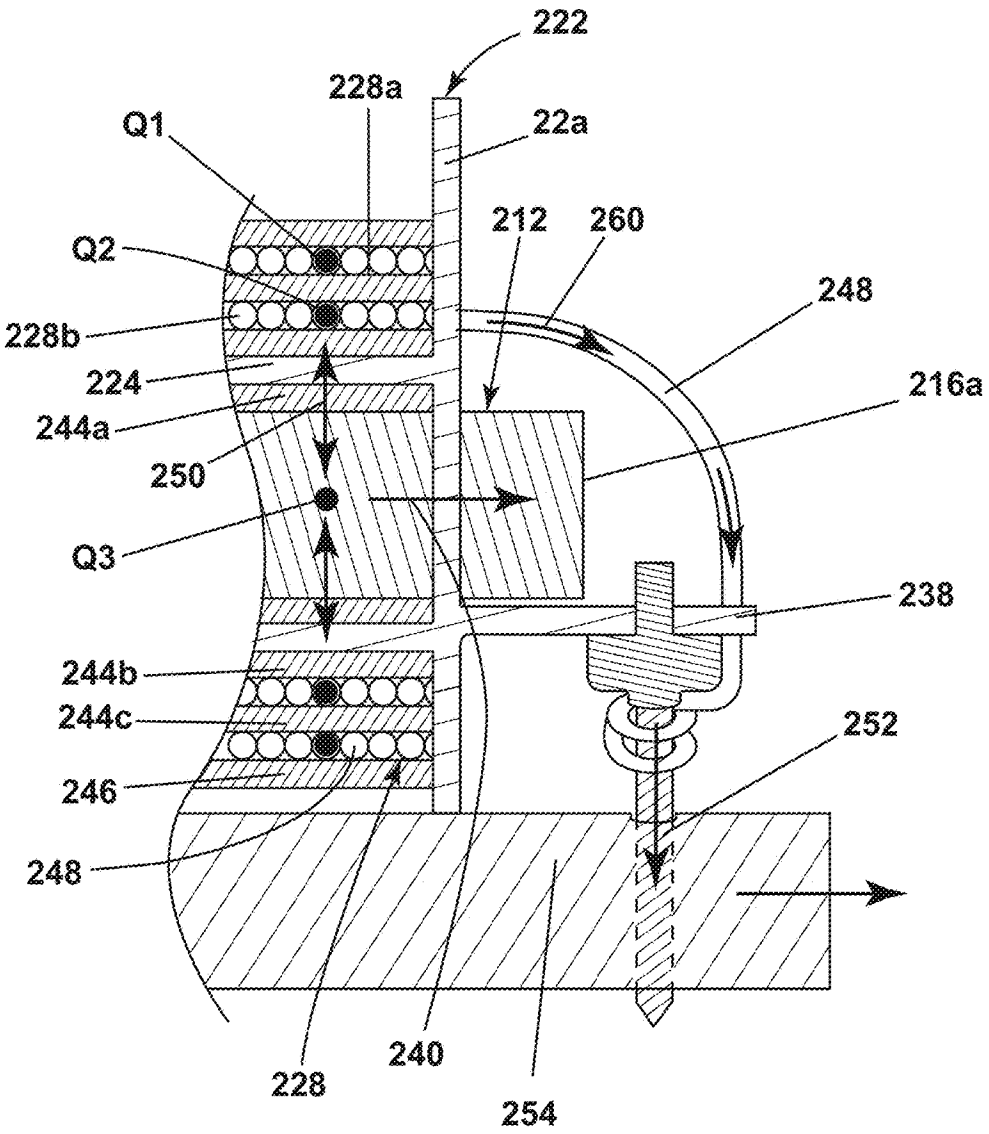
FIG. 5 is a cross-section taken along line V-V of FIG. 4.

Turning to FIG. 5, a cross-section taken along line V-V of FIG. 4 illustrates the electromagnetic device 210 mounted to a circuit board 254. The E-core halve 216*a* can be operably coupled to the circuit board 254 via the set of electrically conductive pins 252. It can more clearly be seen that layers of thermally conductive material 244*a*, 244*b*, 244*c* are disposed between consecutive layers of the primary shank 224 and primary and secondary windings 228*a*, 228*b*.

During operation, electric current traveling through the wires 248 produces heat. It should be understood that the electric current is traveling into and out of the page through the at least one winding 228. The primary winding 228*a* can become a first heat source Q1 and the secondary winding 228*b* can become a second heat source Q2 caused by the electric current. Magnetic flux formed in the PMC 212 by the current flow makes the PMC 212 a third heat source Q3. The back portion 214*c* of the "E" shape of the PMC 12 along with the exterior legs 214*a* and central leg 214*b* form a first heat path 240. Heat from the third heat source Q3 can travel along this first heat path 240 (also illustrated in FIG. 4 in phantom).

A second heat path 250 is formed between the central leg 214*b*, primary shank 224, and the at least one winding 228 by thermally connecting them with the thermally conductive material layers 244*a*, 244*b*, and 244*c* along with an optional outer layer of thermally conductive material 246. Heat from the third heat source Q3 can travel along the first and second thermal heat paths 240, 250 as described herein. Furthermore, a third thermal heat path 260 can be formed by connecting a wire 248 extending from the at least one winding 228 to the circuit board 254. The third thermal heat path 260 enables a direct path through the wire 248 out of the PMC 212 to the circuit board 254. Again the rate at which heat is dissipated is increased by providing a more direct path, and therefore the rate at which heat leaves the circuit board 254 can also be increased. It should be understood that heat will travel towards cooler regions, so the direction or path along which heat is traveling at any time in the electromagnetic device 210 depends on which path forms a more direct route to a cooler region.

It is further contemplated that the method as described herein further includes placing the primary shank 224 about the central legs 214*b* of E-core halves 216*a*, 216*b*. It is also contemplated that the method includes retaining the E-core halves 216*a*, 216*b* in the distal sections 238 of the thermally conductive former 222.

When the thermally conductive former 222 is mounted to the circuit board 254, with the windings 228 terminating into the circuit board 254, a low thermal resistance between the windings 228 and the circuit board 254 and a high thermal resistance between the windings 228 and the PMC 212 is formed. In most cases, it is highly desirable for heat to flow from the electromagnetic device 210 to a cold wall or heatsink rather than flowing into a circuit board or other electronics assembly which may contain temperature sensitive components. However, forming a direct path between the circuit board 254 and the windings 228 also creates a more direct path between the circuit board 254 and surrounding ambient air causing a temperature drop in the circuit board 254. While not illustrated, it will be understood that a cold wall or heatsink can be operably coupled to any suitable portion of the electromagnetic device 210 including to any suitable portion of the PMC(s) 212. Further still, it is also contemplated that a heatsink or cold wall can be operably coupled to the circuit board 254 in any suitable manner.

The electrical device as described herein has a structure that reduces the thermal impedance between the windings and the former, and from the former into the core or surroundings such as a circuit board, thus allowing heat to flow freely from the windings. This enables an extraction of heat originating in the windings into a cold wall or other surroundings. This results in the windings operating at a lower temperature, and thus any insulation surrounding the wire of the windings will not be subjected to high temperatures and resistance of the windings will be lower.

Another advantage when utilizing the cold wall in conjunction with the core, is that heat generated in the windings no longer flows into an electronic component attached to the core, rather the heat flows along a direct path into the cold wall. This allows the electronic device to operate at reduced temperatures, thus increasing the reliability of any electronics in the vicinity. Keeping temperatures down is critical to reliability in aerospace applications.

To the extent not already described, the different features and structures of the various embodiments can be used in combination with each other as desired. That one feature is not illustrated in all of the embodiments is not meant to be construed that it cannot be, but is done for brevity of description. Thus, the various features of the different embodiments can be mixed and matched as desired to form new embodiments, whether or not the new embodiments are expressly described. All combinations or permutations of features described herein are covered by this disclosure.

This written description uses examples, including the best mode, and also to enable any person skilled in the art to practice the disclosure, including making and using any devices or systems and performing any incorporated methods. The patentable scope of the disclosure is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims. For example, while both electromagnetic devices have been illustrated with twin E-cores it will be understood that this need not be the case and that the aspects of the disclosure can be utilized with any suitable core.

Further aspects of the invention are provided by the subject matter of the following clauses:

1. An electromagnetic device, comprising a permeable magnetic core having a plurality of legs; a former located adjacent the permeable magnetic core wherein the former is thermally conductive at a rate equal to or higher than 0.5 W/mK; and at least one winding configured to conduct an electrical current there through wound on the former, the at least one winding including a coil having a plurality of turns; wherein the permeable magnetic core forms at least one thermal heat path and the former is configured to provide at least one additional thermal heat path between the at least one winding and the permeable magnetic core for heat generated in the at least one winding during operation.

2. The electromagnetic device of any preceding clause wherein the permeable magnetic core having a plurality of legs is an E-core having a central leg and two exterior legs and wherein the former is located about the central leg.

3. The electromagnetic device of any preceding clause wherein the at least one winding comprises a primary winding and a secondary winding wound on the former.

4. The electromagnetic device of any preceding clause, further comprising a thermally conductive material having a conductive rate equal to or higher than 0.5 W/mK between at least two of the permeable magnetic core, the former, the primary winding, or the secondary winding.

5. The electromagnetic device of any preceding clause, wherein the thermally conductive material forms at least a portion of the at least one additional heat path.

5. The electromagnetic device of any preceding clause wherein the thermally conductive material is a silicone loaded gap filler located between all of the permeable magnetic core, the former, the primary winding, or the secondary winding.

6. The electromagnetic device of any preceding clause, wherein the former comprises a thermally conductive plastic.

7. The electromagnetic device of any preceding clause, further comprising a thermally conductive material positioned on an outside wall of an exterior leg and configured to transfer heat away from the device.

8. The electromagnetic device of any preceding clause, further comprising a cold wall operably coupled to the thermally conductive material and where the thermally conductive material conducting heat from the at least one winding and the permeable magnetic core into the cold wall.

10. The electromagnetic device of any preceding clause, wherein the E-core comprises first and second identical E-core halves and the former includes an interior section located about the central legs and distal sections extending past the E-core halves.

11. The electromagnetic device of any preceding clause, wherein the E-core halves are retained in the distal sections of the former.

12. The electromagnetic device of any preceding clause, further comprising a set of electrically conductive pins extending from at least one of the distal sections for mounting the electromagnetic device on a circuit board.

13. A method for cooling an electrical device having electrically conductive windings, comprising: placing a thermally conductive former having a primary shank about a leg of a permeable magnetic core having a plurality of legs, the thermally conductive former being capable of conducting heat from the windings at a rate equal to or higher than 0.5 W/mK, with the windings being wound on the shank; and conducting the heat from the windings through thermally conductive former thereby cooling the electrical device.

14. The method of any preceding clause, wherein the permeable magnetic core having a plurality of legs is an E-core having a central leg and two exterior legs and wherein the former is located about the central leg and the at least one winding comprises a primary winding and a secondary winding wound on the former.

15. The method of any preceding clause, further comprising impregnating thermally conductive material between the permeable magnetic core, the former, the primary winding, and the secondary winding.

16. The method of any preceding clause, further comprising operably connecting the electrical device of claim 2 wherein the former comprises a thermally conductive plastic.

17. The method of any preceding clause, further comprising operably coupling at least one of the exterior legs to a cold wall.

18. The method of any preceding clause, wherein the E-core comprises first and second identical E-core halves and placing the thermally conductive former includes placing the shank about the central legs and distal sections extending past the E-core halves.

19. The method of any preceding clause, wherein the E-core halves are retained in the distal sections of the former.

20. The method of any preceding clause, further comprising operably coupling the E-core to a circuit board via a set of electrically conductive pins extending from at least one distal sections of the thermally conductive former.

What is claimed is:

1. An electromagnetic device, comprising:

a permeable magnetic core having a plurality of legs including a central leg;

a former for holding the permeable magnetic core and defining an interior that houses the central leg, wherein the former is thermally conductive at a rate equal to or higher than 0.5 W/mK;

a first layer of thermally conductive material located between and spacing the central leg from the former and having a thermal conductive rate equal to or higher than 0.5 W/mK;

at least one winding configured to conduct an electrical current there through wound on the former, the at least one winding including a coil having a plurality of turns; and a cold wall operably coupled to the thermally conductive material;

wherein the permeable magnetic core, the first layer of thermally conductive material, and the former, together define at least one thermal heat path between the at least one winding and the cold wall, the thermally conductive material conducting heat generated in the at least one winding during operation through the permeable magnetic core into the cold wall.

2. The electromagnetic device of claim 1, wherein the permeable magnetic core having a plurality of legs is an E-core with the central leg and two exterior legs and wherein the former is located about the central leg.

3. The electromagnetic device of claim 2, wherein the at least one winding comprises a primary winding and a secondary winding wound on the former.

4. The electromagnetic device of claim 3, further comprising a second layer of thermally conductive material having a conductive rate equal to or higher than 0.5 W/mK located between the former and the primary winding, or the secondary winding.

5. The electromagnetic device of claim 4, wherein the second layer of thermally conductive material forms at least a portion of the at least one thermal heat path.

6. The electromagnetic device of claim 4, wherein the first layer and the second layer of thermally conductive materials are both silicone loaded gap fillers.

7. The electromagnetic device of claim 1, wherein the former comprises a thermally conductive plastic.

8. The electromagnetic device of claim 2, further comprising a thermally conductive material positioned on an outside wall of at least one of the two exterior legs and configured to transfer heat away from the electromagnetic device.

9. The electromagnetic device of claim 8, wherein the cold wall is operably coupled to the thermally conductive material and where the thermally conductive material further defines the at least one thermal heat path.

10. The electromagnetic device of claim 2, wherein the E-core comprises first and second identical E-core halves and the former includes an interior section located about the central legs and distal sections extending past the E-core halves.

11. The electromagnetic device of claim 10, wherein the E-core halves are retained in the distal sections of the former.

12. The electromagnetic device of claim 10, further comprising a set of electrically conductive pins extending from at least one of the distal sections for mounting the electromagnetic device on a circuit board.

13. A method for cooling an electrical device having electrically conductive windings, comprising:

placing a thermally conductive former having a primary shank about a leg of a permeable magnetic core having a plurality of legs, the thermally conductive former being capable of conducting heat from the windings at a rate equal to or higher than 0.5 W/mK, with the windings being wound on the shank;

spacing the primary shank from the leg with a first layer of thermally conductive material capable of conducting heat from the windings at a rate equal to or higher than 0.5 W/mK, operably coupling the leg to a cold wall, and conducting the heat from the windings through the thermally conductive former, the first layer of thermally conductive material, and the permeable magnetic core into the cold wall thereby cooling the electrical device.

14. The method of claim 13 wherein the permeable magnetic core having a plurality of legs is an E-core having a central leg and two exterior legs and wherein the former is located about the central leg and the at least one winding comprises a primary winding and a secondary winding wound on the former.

15. The method of claim 14, further comprising impregnating a second layer of thermally conductive material between the former and the secondary winding.

16. The method of claim 15, further comprising operably connecting the electrical device of claim 2 wherein the former comprises a thermally conductive plastic.

17. The method of claim 14, wherein the E-core comprises first and second identical E-core halves and placing the thermally conductive former includes placing the shank about the central legs and distal sections extending past the E-core halves.

18. The method of claim 17, wherein the E-core halves are retained in the distal sections of the former.

19. The method of claim 17, further comprising operably coupling the E-core to a circuit board via a set of electrically conductive pins extending from at least one distal sections of the thermally conductive former.

20. The electromagnetic device of claim 4, further comprising a third layer of thermally conductive material located between the primary winding and the secondary winding and wherein the first layer of thermally conductive material is located between the central leg and the former and the second layer of thermally conductive material is located between the former and the primary winding.

* * * * *